US005946955A

United States Patent [19]

Suggs et al.

[11] Patent Number: 5,946,955

[45] Date of Patent: Sep. 7, 1999

[54] DOOR LATCH/LOCK CONTROL

[75] Inventors: Stephen J. Suggs, 7217 Westhampton Pl., Knoxville, Tenn. 37919; Arnold E. Frost, Knoxville; Tony Chung, Oak Ridge, both of Tenn.

[73] Assignees: Stephen J. Suggs; Arnold Eugene Frost, both of Knoxville, Tenn.

[21] Appl. No.: 08/847,656

[22] Filed: Apr. 30, 1997

[51] Int. Cl.[6] ..... E05B 13/10

[52] U.S. Cl. ..... 70/218; 70/283; 70/278

[58] Field of Search ..... 70/218–224, 277–283

[56] References Cited

U.S. PATENT DOCUMENTS

| | | | |
|---|---|---|---|
| 3,785,188 | 1/1974 | Drathschmidt | 70/273 X |
| 4,148,092 | 4/1979 | Martin | 70/278 X |
| 4,177,657 | 12/1979 | Aydin | 70/223 X |
| 4,671,087 | 6/1987 | Olenfalk et al. | 70/218 X |
| 4,854,143 | 8/1989 | Corder et al. | 70/223 X |
| 5,000,018 | 3/1991 | Elsermann | 70/223 X |
| 5,061,923 | 10/1991 | Miller et al. | 70/278 X |
| 5,372,025 | 12/1994 | Lin | 70/223 X |
| 5,437,174 | 8/1995 | Aydin | 70/278 |
| 5,475,996 | 12/1995 | Chen | 70/218 X |
| 5,609,051 | 3/1997 | Donaldson | 70/278 |
| 5,640,862 | 6/1997 | Remenicky | 70/278 |
| 5,712,626 | 1/1998 | Andrew et al. | 70/278 |

*Primary Examiner*—Suzanne Dino Barrett
*Attorney, Agent, or Firm*—Peter J. Van Bergen

[57] ABSTRACT

A control system is provided to lock, unlock and/or unlatch a door's lock and/or latch mechanism(s) having a bolt(s) coupled to a shaft(s). In one embodiment, a clutch is coupled to the shaft for rotation therewith. The clutch includes a movable lever attached thereto with a bias that causes the lever to protrude axially from the clutch. A plate is mounted coaxially with the shaft for free rotation relative thereto. The plate is adjacent the clutch on a side thereof from which the lever protrudes. The plate includes a notch formed therein facing the clutch. The plate and clutch are biased toward one another so that the plate and lever contact one another as the bias between the plate and the clutch overcomes the bias of the lever. A remotely-activated motorized drive is coupled to the plate for rotating the plate relative to the shaft in a direction of rotation that allows the lever to engage the notch. As a result of such engagement, rotation of the plate is transferred to the clutch for rotating the shaft until rotational resistance is experienced by the shaft. The system can also momentarily maintain the door's latching mechanism in its "open" position so that the door can be pushed open.

19 Claims, 2 Drawing Sheets

DOOR LATCH/LOCK CONTROL

FIELD OF THE INVENTION

The invention relates generally to door latch and latch/lock mechanisms, and more particularly to a control system for use with a door latch and/or lock mechanism(s) to control the locking, unlocking and unlatching thereof.

BACKGROUND OF THE INVENTION

Throughout a typical home dwelling, doors use one of a non-lockable latchbolt, lockable latchbolt, or latchbolt/deadbolt arrangement operated by one or more keys and/or a door knob. These arrangements require the full use of at least one hand to lock, unlock and/or unlatch (i.e., open) the door. This can present problems for the elderly, the handicapped or anyone with limited use of their hands when it is time to unlock or unlatch a door. Accordingly, a variety of keyless electromechanical door locks have been developed over the years. However, the devices available can be very expensive and generally require the complete removal of existing door lock mechanisms or substantial modifications thereof. They also do not allow for hands-free unlatching of a door so that it can be pushed open without, for example, the turning of a doorknob.

SUMMARY OF THE INVENTION

Accordingly, it is an object of the present invention to provide a door latch/lock control system that operates to lock, unlock and/or unlatch a door.

Another object of the present invention is to provide a keyless, door latch/lock control system that allows a user to lock, unlock and/or unlatch a door without having to use one's hands to operate any portion of a door latch/lock mechanism installed in a door.

Still another object of the present invention is to provide a door latch/lock control system that is easily installed to work in conjunction with a door's existing latch and/or lock mechanism(s).

Yet another object of the present invention to provide a door lock control that can be manually overridden.

Other objects and advantages of the present invention will become more obvious hereinafter in the specification and drawings.

In accordance with the present invention, a door latch/lock control system cooperates with at least one door mechanism having a bolt coupled to a shaft. The bolt is movable between a protruding position and a withdrawn position as controlled by the rotation of the shaft. The shaft can experience a rotational resistance at the protruding and withdrawn positions. The system can be operated to lock, unlock and/or unlatch the door's latch and/or lock mechanism(s). In one embodiment, a clutch is coupled to the shaft for rotation therewith. The clutch includes a movable lever attached thereto with a bias that causes the lever to protrude axially from the clutch. A plate is mounted coaxially with the shaft for free rotation relative thereto. The plate is adjacent the clutch on a side thereof from which the lever protrudes. The plate includes a notch formed therein facing the clutch. The plate and clutch are biased toward one another so that the plate and lever contact one another as the bias between the plate and the clutch overcomes the bias of the lever. A motorized drive is coupled to the plate for rotating same relative to the shaft in a direction of rotation that allows the lever to engage the notch. As a result of such engagement, rotation of the plate is transferred via the lever to the clutch for rotating the shaft until the rotational resistance is experienced by the shaft. At that point, the rotational resistance is transferred from the shaft through the clutch and lever to the plate so that the plate and clutch experience axial movement away from one another as the bias between the plate and clutch is momentarily overcome. This allows the plate to again freely rotate about the shaft with the notch caused to disengage from the lever as the plate moves in the direction of rotation. The system can also momentarily maintain the door's latching mechanism in its "open" position so that the door can be pushed open.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
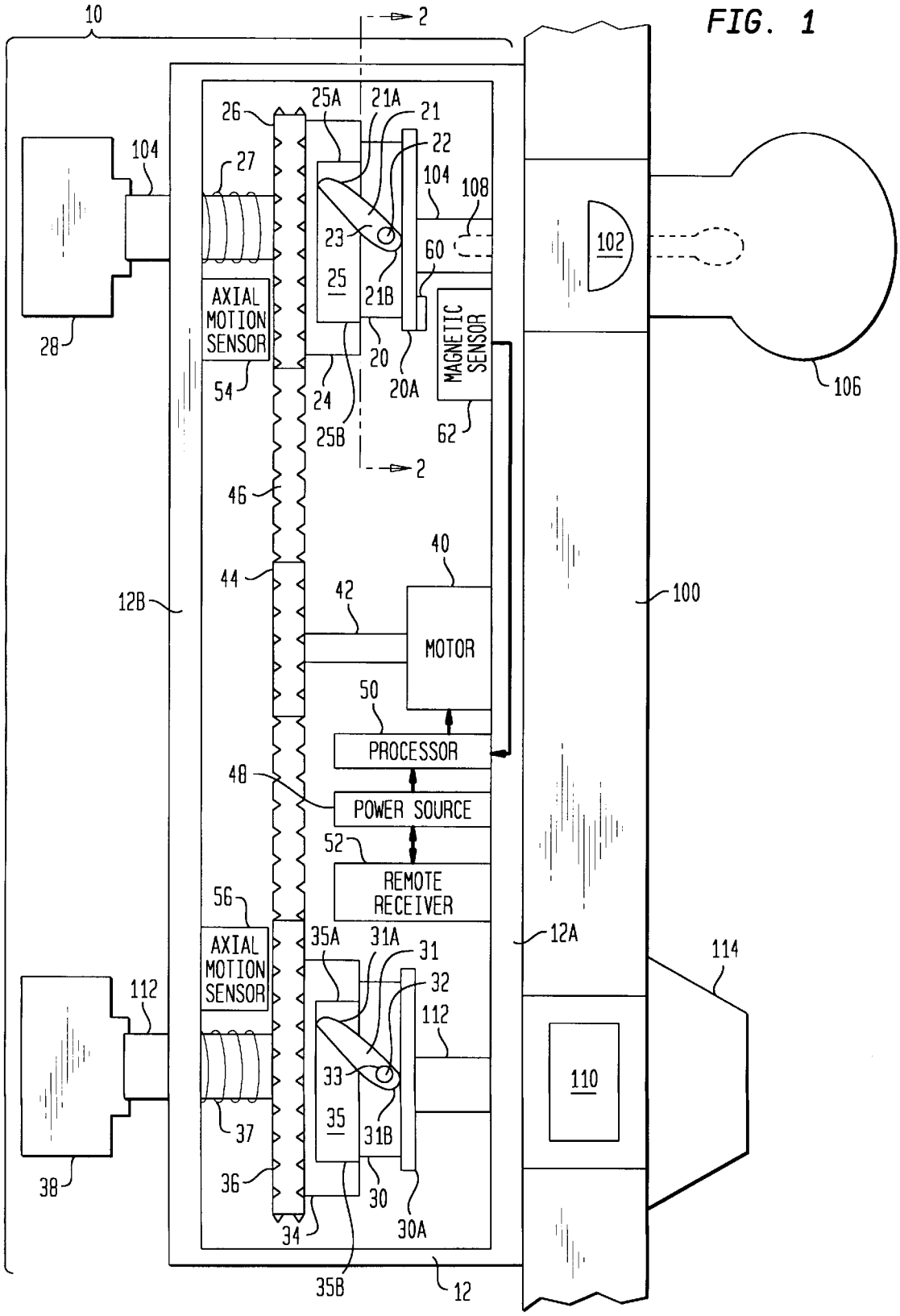
FIG. 1 is in part a side view and in part a schematic view of one embodiment of a door lock control according to the present invention coupled to a door lock mechanism that has a latchbolt and a deadbolt.

Referring now to the drawings, and more particularly to FIG. 1, an embodiment of a door latch/lock control system according to the present invention is shown and is referenced generally by numeral 10. Door latch/lock control system 10 is shown installed on a door 100 that has conventional latchbolt and deadbolt lock mechanisms. More specifically, a latchbolt 102 is coupled to latchbolt shaft 104 that is coupled to an exterior doorknob 106. As is typical of latchbolt lock mechanisms, latchbolt 102 is spring-biased in its protruding position and can be withdrawn into the latchbolt mechanism when shaft 104 is turned, i.e., rotated about is longitudinal axis. Typically, the latchbolt mechanism will incorporate a locking pin 108, the position of which inhibits or permits rotation of shaft 104 by the turning of exterior doorknob 106. However, it is to be understood that the present invention can also be used with a non-lockable latchbolt, i.e., one that does not include locking pin 108 or other locking apparatus that prevents latchbolt 102 from being moved to its withdrawn position. Such latchbolt mechanisms are well understood in the art and will therefore not be discussed further herein.

Similarly, a deadbolt 110 is coupled to a deadbolt shaft 112 that is coupled to a key lock mechanism 114. Deadbolt 110 is movable between its protruding position and withdrawn position by axial rotation of deadbolt shaft 112. Once again, such deadbolt mechanisms are well understood in the art and will therefore not be discussed further herein.

By way of example, the present invention will be described relative to its operation with a door having both a latchbolt and deadbolt mechanism installed therein.

However, the present invention could be easily adapted for use with a door having only a latchbolt mechanism (lockable or non-lockable), only a deadbolt mechanism, or more than the two lock mechanisms shown in FIG. 1.

Door latch/lock control system 10 is maintained within a housing 12 that includes a back plate 12A and a cover plate 12B. For security reasons, door latch/lock control system 10 would typically be mounted on the inside of door 100 by attaching back plate 12A to door 100 in any one of a variety of fashions. For example, the bolt mounting system (not shown) typically used to fix the latchbolt and deadbolt mechanism to door 100 could be used to simultaneously couple housing 12 to door 100.

The mechanical features of the present invention are essentially the same for controlling the operation of latchbolt 102 and deadbolt 110. Accordingly, a description of the mechanical features relative to latchbolt 102 will also serve as a description of the mechanical features relative deadbolt 110. Reference numerals in the 20's will be used to describe the mechanical features associated with latchbolt 102 and corresponding reference numerals in the 30's will be used to describe the corresponding mechanical features associated with deadbolt 110.

With respect to latchbolt 102, a clutch 20 is coupled to latchbolt shaft 104 such that the combination of latchbolt shaft 104 and clutch 20 rotate together. Note that the portion of latchbolt shaft 104 extending from door 100 through housing 12 can be the existing shaft of the latchbolt mechanism or can be an extension adapted to cooperate with the existing shaft and locking pin 108 of the latchbolt mechanism.

A lever 21 is attached to clutch 20 at a pivot point by means of, for example, a pivot pin 22. Lever 21 is thus pivotable through an angle about pivot pin 22. For reasons that will be explained further below, lever 21 is biased so that its tip 21A tries to align itself along the longitudinal axis of latchbolt shaft 104 thereby causing tip 21A to extend beyond clutch 20. One way of biasing lever 21 in this fashion is to provide a spring 23 cooperating with clutch 20 and lever 21 about pivot pin 22. Clutch 20 can further be configured to provide a back support 20A that is in tangential contact with end 21B of lever 21 so that end 21B is pressed against back support 20A as lever 21 pivots about pivot pin 22. Reasons for possibly doing this will become apparent hereinbelow.

Figure 2:
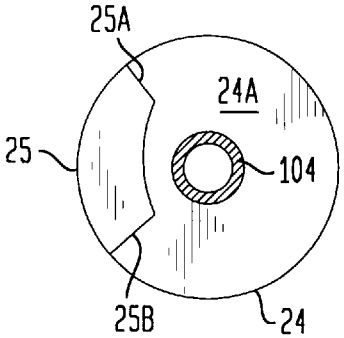
FIG. 2 is a view of the free-spinning plate and the latchbolt shaft as taken along line 2—2 of FIG. 1.

Mounted about latchbolt shaft 104 adjacent clutch 20 is a plate 24 that can rotate about shaft 104 independently of any rotation thereof. More specifically, plate 24 is positioned on the side of clutch 20 from which lever 21 is biased to protrude therefrom. Free-spinning rotation of plate 24 can be facilitated by use of bearings (not shown) interposed between plate 24 and latchbolt shaft 104 as would be well understood by one of ordinary skill in the art. Plate 24 incorporates a notch 25 indented in one face thereof facing lever 21. As shown in the plan view of FIG. 2 taken along line 2—2 of FIG. 1, notch 25 is formed such that tip 21A cooperates with one of edges 25A and 25B of notch 25 as will be explained more fully below.

In the illustrated embodiment, a pulley 26 (e.g., a toothed pulley) is fixedly coupled to plate 24. A toothed endless belt 46 cooperates with pulley 26 to translate movement of belt 46 to rotation of plate 24 in either of two rotational directions. In the present invention, plate 24 and clutch 20 are biased towards one another along latchbolt shaft 104. While this can be accomplished in a variety of ways, one way is illustrated in the embodiment of FIG. 1.

Figure 3:
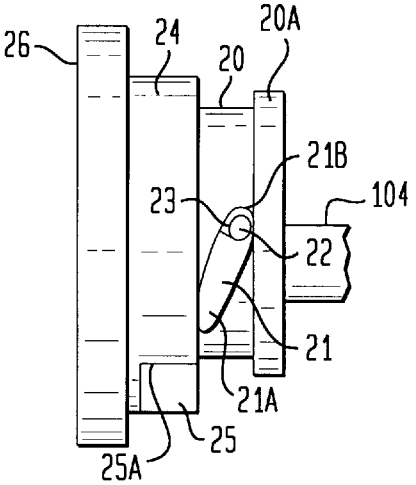
FIG. 3 is an isolated view of the free-spinning plate and clutch when the notch in the plate is not aligned with the clutch's pivoting lever.

A coil spring 27 is mounted about latchbolt shaft 104 between cover plate 12B and pulley 26 to bias (pulley 26 and) plate 24 towards clutch 20 so that lever 21 and plate 24 are in contact with one another. The biasing power of spring 27 is greater than that of spring 23 used to bias lever 21. Accordingly, in its biased position, plate 24 causes lever 21 to pivot about pin 22 against the bias of spring 23. When notch 25 is aligned over lever 21, the bias of spring 23 causes tip 21A to snap into notch 25. However, when face 24A of plate 24 is aligned and in contact with lever 21 as shown in the isolated view of FIG. 3, tip 21A is pivoted further towards clutch 20.

Latchbolt shaft 104 passes through cover plate 12B and has a knob 28 affixed thereto for the conventional manual operation of the latchbolt mechanism. Similarly, deadbolt shaft 112 passes through cover plate 12B and has knob 38 affixed thereto for manual operation of the deadbolt mechanism. To accommodate a variety of spacing s between the latchbolt and deadbolt mechanisms, holes (not shown) in back plate 12A and cover plate 12B receiving latchbolt shaft 104 and deadbolt shaft 112, respectively, can be oblong in the vertical direction.

The mechanical features described above are combined with electromechanical features so that door lock control 10 can be locked, unlocked and unlatched in a keyless and/or remote fashion. In general, the electromechanical features of the present invention include drive and control mechanisms, for rotating each of plates 24 and 34 when the latchbolt and deadbolt mechanisms are to be operated, i.e., locked or unlocked and unlatched. By way of example, one way of accomplishing this is illustrated and will now be described. However, it is to be understood that other drive and control mechanism can be used in door lock control 10 without departing from the scope of the present invention.

A bi-directional motor 40 has a drive shaft 42 coupled to endless toothed belt 46 via a drive gear 44 mounted on drive shaft 42. As mentioned above, toothed belt 46 cooperates with pulleys 26 and 36 to provide the rotational drive for plates 24 and 34, respectively. Power for motor 40 can be supplied by a power source 48 as coupled thereto through a processor 50. Power source 48 is representative of any self-contained source (e.g., a battery) or a line source of power wired to door lock control 10.

Processor 50 is representative of any processing device capable of processing the various externally received or internally generated control signals. In terms of externally received control signals, a remote sensor or receiver 52 is provided and is coupled to processor 50. Remote receiver 52 is representative of any receiver designed to receive remotely generated control signals that will trigger activation of door lock control 10. For example, remote receiver 52 can be an infrared receiving device, a voice activated receiving device, a proximity receiving device, etc., any of which are understood in the art. Note that certain receiving devices may require the location of a "pick-up" device (not shown) on the exterior of housing 12. Receipt of any remotely-sent control signal is passed to processor 50 which, in turn, controls the starting and stopping of motor 40.

Both latchbolt shaft 104 and deadbolt shaft 112 are capable of rotation in both rotational directions. Shaft 104 meets rotational resistance when latchbolt 102 is in its unlatched or withdrawn position. When in its locked position, latchbolt 102 is in its protruding position and latchbolt shaft 104 cannot turn in either direction. Finally, when in its unlocked but latched position, latchbolt 102 is in its protruding position while latchbolt shaft 104 can rotate in either of the two rotational directions. Deadbolt shaft 112 meets rotational resistance when deadbolt 110 is either in its fully protruding position or fully withdrawn position.

As will be explained in greater detail below, the rotational resistance of either shaft is translated to the respective clutch when the clutch's lever engages the notch of the adjacent spinning plate. As a result, the respective plate (and pulley in the illustrated embodiment) are moved axially against the respective coil spring. This axial movement of each plate signifies the end of lock or unlock/unlatch cycle. Accordingly, axial motion sensors 54 and 56 are positioned to provide an indication of the axial movement to processor 50 which, in turn, shuts off motor 40. Axial motion sensors 54 and 56 can be, for example, micro limit switches or proximity switches.

Prior to operation, levers 21 and 31 must be pre-positioned with their respective tips 21A and 31A facing into the next expected rotational direction of plates 24 and 34. For example, if both the latchbolt and deadbolt mechanisms are initially configured to be unlocked, latchbolt 102 is in its protruding position with latchbolt shaft 104 able to turn and deadbolt 110 is in its withdrawn position. In this case, tips 21A and 31A are pre-set or angled to engage what will be the trailing edge (e.g., edges 25A and 35A in FIG. 1) of notches 25 and 35 as pulleys 26 and 36 are rotated (in a counter-clockwise direction in the illustrated embodiment). Assuming this to be the case, operation of the present invention will now be explained for both the locking and unlocking/unlatching modes. The description will focus on the latchbolt mechanism with it being understood that operation of the deadbolt mechanism follows in correspondence therewith.

To lock the latchbolt (and deadbolt) mechanism(s), door lock control 10 receives a lock control signal at remote receiver 52. Processor 50 then starts motor 40 in response to the lock control signal so that belt 46 turns in the counter-clockwise direction for the illustrated example. As notch 25 aligns with lever 21, tip 21A engages notch edge 25A. The rotation of plate 24 is thereby coupled to clutch 20. Latchbolt shaft 104 is turned because of its fixed engagement with clutch 20. Latchbolt shaft 104 rotates locking pin 108 to its locked position at which point shaft 104 meets rotational resistance. As mentioned above, the rotational resistance is transferred through clutch 20 and lever 21 to plate 24.

The rotational resistance causes several things to happen in quick succession. Plate 24 moves axially against the bias of coil spring 27. Lever 21 is thus no longer fixed in its engagement with notch 25 so plate 24 is no longer locked into engagement with clutch 20 and therefore begins to rotate again about shaft 104. Tip 21A is pivoted about pin 22 in the direction of rotation of plate 24 and so that lever 21 ends up facing generally along the direction of rotation. (Note that the presence of back support 20A can relieve stresses on pivot pin 22 as lever 21 pivots as just described.) The axial movement of plate 24 trips axial movement sensor 54 (via corresponding axial movement of pulley 26 in the illustrated example). Sensor 54 supplies processor 50 with a stop signal in order to stop motor 40.

Corresponding locking operations transpire simultaneously for the deadbolt mechanism. However, note that if the operational rotation angles of the latchbolt and deadbolt mechanism differ, pulleys 26 and 36 must be sized differently to provide synchronization between the two mechanisms. In addition, in order to assure that both the latchbolt and deadbolt mechanisms have completed their locking cycles, processor 50 can be programmed to stop motor 40 only when stop signals are received from each of axial movement sensors 54 and 56. Staggered finish-cycle times present no problem in the present invention. This is because once the lever has "snapped" over and is angled generally in the direction of rotation, the tip of that lever will not engage the respective notch upon any subsequent rotations of the plate in the same direction. The unlocking of the latchbolt and deadbolt mechanisms is accomplished in the same fashion as motor 40 simply rotates belt 46 in the opposite (e.g., clockwise) direction.

An additional feature of the present invention is its ability to withdraw latchbolt 102 into its withdrawn position and freeze it there until a user has time to push open door 100. In terms of the illustrated embodiment, motor 40 is activated and turns belt 46 in a clockwise direction. Lever 21 is now engaged in edge 25B of notch 25 so that rotation of plate 24 is coupled through clutch 20 to shaft 104. Locking pin 108 is rotated to the unlock position and shaft 104 continues to rotate clockwise since there is no rotational resistance experienced thereby. The continued rotation of shaft 104 causes latchbolt 102 to be withdrawn in accordance with the operation of the latchbolt mechanism. Once latchbolt 102 is withdrawn, but prior to shaft 104 meeting its rotational resistance, the present invention freezes motor 40 to keep latchbolt 102 withdrawn. While this can be accomplished in a variety of fashions, one way is shown in FIG. 1. A magnet 60 can be placed on clutch 20 and a magnetic sensor 62 can be mounted in housing 12 and coupled to processor 50. Magnet 60 is placed on clutch 20 in a position such that it is detected by sensor 62 just as latchbolt 102 reaches its withdrawn position but prior to shaft 104 experiencing rotational resistance. Such detection is processed by processor 50 to freeze motor 40 for a period of time (e.g., 10 seconds) to allow a user to push open the door. At the conclusion of the period of time, the motor is again turned in the same direction of rotation so that shaft 104 can experience rotational resistance. As in the locking of latchbolt 102, the rotational resistance brings about axial movement of plate 24 to allow lever 21 to once again snap over in the direction of rotation and to stop motor 40.

The advantages of the present invention are numerous. A simple remote door lock control system is presented for the remote locking, unlocking and unlatching of multiple lock mechanisms. The system is easily adopted to existing lock mechanisms or can be incorporated into a whole new lock mechanism. Since the plates (e.g., plates 24 and 34) are free to spin about their respective shafts, each door lock mechanism can always be operated manually from both the interior and exterior sides of the door.

Figure 4:
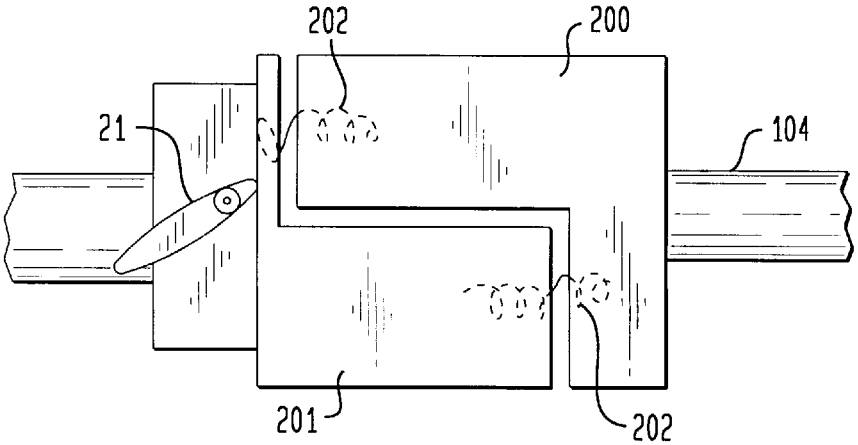
FIG. 4 is an isolated view of an alternative embodiment clutch that is formed from two interlocking halves biased away from one another axially by means of one or more springs.

Although the invention has been described relative to a specific embodiment thereof, there are numerous variations and modifications that will be readily apparent to those skilled in the art in light of the above teachings. For example, the belt and pulley drive system used for both lock mechanisms could be replaced with individual drive systems. Other types of drive systems such as screw or spur gear drives could be coupled to the free-spinning plates. In other alternatives, magnet 60 and magnetic sensor 62 could be replaced with an optical, proximity or other triggering system. In another variation, the biasing of lever 21 to plate 24 could be accomplished by a magnetic attraction. In still another variation, each clutch could provide the necessary bias towards the respective plate. For example, as shown in FIG. 4, interlocking halves 200 and 201 replace clutch 20 used in the embodiment depicted in FIG. 1. Clutch half 200 is fixed to shaft 104 for rotation therewith. Clutch half 201 is interlocked with half 200 such that halves 200 and 201 rotate about shaft 104 in unison. At the same time, clutch half 201 can move axially along shaft 104. One or more springs 202 are used to bias clutch half 201 away from clutch half 200. Lever 21 depends from clutch half 201 in the same fashion as that described above. Furthermore, the clutch, lever and free-spinning plate combination will find great utility in a variety of other applications where a shaft experiences rotational resistance in each of two directions. It is to be further understood that other types of devices could be used to uncouple the shaft from the drive mechanism at the point of rotational resistance. For example, other types of clutch devices could include a slip clutch, an adjustable momentary overload clutch or a roller clutch. Another option is to replace the clutch-type device with another device such as a gear mechanism. It is therefore to be understood that, within the scope of the appended claims, the invention may be practiced other than as specifically described.

What is claimed as new and desired to be secured by Letters Patent of the United States is:

1. A control system for at least one door mechanism having a bolt coupled to a shaft, said bolt being movable between a protruding position and a withdrawn position as controlled by the rotation of said shaft wherein said shaft can experience a rotational resistance at each of said protruding position and said withdrawn position, said control system comprising:

a clutch coupled to said shaft for rotation therewith, said clutch including a movable lever attached thereto and having a bias that causes said lever to protrude axially from said clutch;

a plate mounted coaxial with said shaft for free rotation relative thereto, said plate residing adjacent said clutch on a side thereof from which said lever protrudes, said plate including a notch formed therein facing said clutch, said plate and said clutch biased toward one another wherein said plate and said lever contact one another and the bias between said plate and said clutch overcomes the bias of said lever; and a motorized drive coupled to said plate for rotating said plate relative to said shaft in a direction of rotation that allows said lever to engage said notch so that rotation of said plate is transferred via said lever to said clutch for rotating said shaft until said rotational resistance is experienced, wherein said rotational resistance is transferred from said shaft through said clutch and said lever to said plate so that said plate and said clutch experience axial movement away from one another as the bias between said plate and said clutch is momentarily overcome wherein said plate again freely rotates about said shaft so that said notch disengages from said lever as said plate moves in said direction of rotation.

2. A control system as in claim 1 further comprising a device for detecting said axial movement and for stopping rotation of said plate upon detecting said axial movement.

3. A control system as in claim 1 wherein said bolt is biased to assume said protruding position, said control system further comprising a device for detecting a position of said bolt just prior to said withdrawn position, for inhibiting rotation of said plate for a period of time upon detection of said position of said bolt, and for permitting rotation of said plate at the expiration of said period of time.

4. A control system as in claim 1 further comprising a user-activated controller for activating said motorized drive to begin rotating said plate.

5. A control system as in claim 4 wherein said user-activated controller includes a remote-signal sensing device coupled to said motorized drive for sensing a remotely sent activation signal used to activate said motorized drive to begin rotating said plate.

6. A control system as in claim 1 wherein said motorized drive comprises:

at least one motor for supplying a motive force; and a mechanical linkage coupling said at least one motor to said plate for delivering said motive force to said plate, wherein said at least one motor and said mechanical linkage cooperate to rotate said plate in either one of two directions so that said shaft can experience rotation in said either one of two directions when said notch engages said lever.

7. A control system for a door lock mechanism having a plurality of bolts, each of said plurality of bolts coupled to a shaft and movable between a protruding position and a withdrawn position as controlled by the rotation of said shaft wherein each said shaft can experience a rotational resistance at each of said protruding position and said withdrawn position, and for each of said plurality of bolts, said control system comprising:

a clutch coupled to said shaft for rotation therewith, said clutch including a lever pivotally attached thereto and having a bias that causes said lever to protrude axially from said clutch;

a plate mounted coaxial with said shaft for free rotation relative thereto, said plate residing adjacent said clutch on a side thereof from which said lever protrudes, said plate including a notch formed partially in a face thereof and facing said clutch;

a spring mechanism having a bias for biasing said plate and said clutch toward one another wherein said plate and said lever contact one another to pivot said lever towards said clutch;

a motorized drive coupled to said plate for rotating said plate relative to said shaft in a direction of rotation that allows said lever to engage said notch so that rotation of said plate is transferred via said lever to said clutch for rotating said shaft until said rotational resistance is experienced, wherein said rotational resistance is transferred from said shaft through said clutch and said lever to said plate so that said plate and said clutch experience axial movement away from one another as said bias of said spring mechanism is momentarily overcome wherein said plate again freely rotates about said shaft so that said notch pivots said lever in said direction of rotation.

8. A control system as in claim 7 wherein said spring mechanism is coupled to said plate.

9. A control system as in claim 7 further comprising a device for detecting said axial movement of said plate associated with at least one of said plurality of bolts and for stopping rotation of said plate associated with said at least one of said plurality of bolts upon detecting said axial movement.

10. A control system as in claim 1 wherein at least one of said plurality of bolts is a latchbolt biased to assume said protruding position, said control system further comprising a device for detecting a position of said latchbolt just prior to said withdrawn position, for inhibiting rotation of said plate associated with said latchbolt for a period of time upon detection of said position of said latchbolt, and for permitting rotation of said plate associated with said latchbolt at the expiration of said period of time.

11. A control system as in claim 7 wherein said motorized drive for said plurality of bolts comprises:

at least one motor for supplying a motive force; and a mechanical linkage coupling said at least one motor to each said plate for delivering said motive force to each said plate, wherein said at least one motor and said mechanical linkage cooperate to rotate each said plate simultaneously in either one of two directions so that each said shaft can experience rotation in said either one of two directions when each said notch engages a respective said lever.

12. A control system as in claim 11 further comprising a user-activated controller for activating said at least one motor to begin rotating each said plate.

13. A control system as in claim 12 wherein said user-activated controller includes a remote-signal sensing device coupled to said motor for sensing a remotely sent activation signal used to activate said at least one motor to begin rotating each said plate.

14. A control system for a door lock mechanism having a latchbolt and a deadbolt, said latchbolt coupled to a first shaft and movable between a protruding position and a withdrawn position as controlled by the rotation of said first shaft, and said deadbolt coupled to a second shaft and movable between a protruding position and a withdrawn position as controlled by the rotation of said second shaft, wherein each of said first shaft and said second shaft can experience a rotational resistance at each of said protruding position and said withdrawn position of said latchbolt and said deadbolt, respectively, said control system comprising:

a first clutch coupled to said first shaft for rotation therewith, said first clutch including a first lever pivotally attached thereto and having a bias that causes said first lever to protrude axially from said first clutch;

a first plate mounted coaxial with said first shaft for free rotation relative thereto, said first plate residing adjacent said first clutch on a side thereof from which said first lever protrudes, said first plate including a notch formed partially in a face thereof and facing said first clutch;

a first spring mechanism having a bias for biasing said first plate and said first clutch toward one another wherein said first plate and said first lever contact one another to pivot said first lever towards said first clutch;

a second clutch coupled to said second shaft for rotation therewith, said second clutch including a second lever pivotally attached thereto and having a bias that causes said second lever to protrude axially from said second clutch;

a second plate mounted coaxial with said second shaft for free rotation relative thereto, said second plate residing adjacent said second clutch on a side thereof from which said second lever protrudes, said second plate including a notch formed partially in a face thereof and facing said second clutch;

a second spring mechanism having a bias for biasing said second plate and said second clutch toward one another wherein said second plate and said second lever contact one another to pivot said second lever towards said second clutch;

a motorized drive, coupled to said first plate and said second plate, for rotating said first plate about said first shaft and for rotating said second plate about said second shaft in a direction of rotation that allows said first lever to engage said notch on said first plate and said second lever to engage said notch on said second plate, wherein rotation of said first plate is transferred via said first lever to said first clutch for rotating said first shaft until said rotational resistance is experienced, wherein said rotational resistance is transferred from said first shaft through said first clutch and said first lever to said first plate so that said first plate and said first clutch experience axial movement away from one another as the bias of said first spring mechanism is momentarily overcome wherein said first plate again freely rotates about said first shaft so that said notch in said first plate pivots said first lever in said direction of rotation, and wherein rotation of said second plate is transferred via said second lever to said second clutch for rotating said second shaft until said rotational resistance is experienced, wherein said rotational resistance is transferred from said second shaft through said second clutch and said second lever to said second plate so that said second plate and said second clutch experience axial movement away from one another as the bias of said second spring mechanism is momentarily overcome wherein said second plate again freely rotates about said second shaft so that said notch in said second plate pivots said second lever in said direction of rotation;

a device for detecting said axial movement associated with at least one of said first plate and said second plate and for stopping rotation of said at least one of said first plate and said second plate upon detecting said axial movement; and a user-activated controller for activating said motorized drive to begin rotating said first plate and said second plate.

15. A control system as in claim 14 wherein said latchbolt is biased to assume said protruding position, said control system further comprising a device for detecting a position of said latchbolt just prior to said withdrawn position, for inhibiting rotation of said first plate for a period of time upon detection of said position of said latchbolt, and for permitting rotation of said first plate at the expiration of said period of time.

16. A control system as in claim 14 wherein said user-activated controller includes a remote-signal sensing device coupled to said motorized drive for sensing a remotely sent activation signal used to activate said motorized drive to begin rotating said first plate and said second plate.

17. A control system as in claim 14 wherein said motorized drive comprises:

at least one motor for supplying a motive force; and a mechanical linkage coupling said at least one motor to said first plate and said second plate for delivering said motive force thereto, wherein said at least one motor and said mechanical linkage cooperate to rotate said first plate and said second plate in either one of two directions so that said first shaft and said second shaft can experience rotation in said either one of two directions when said notch in said first plate engages said first lever and said notch in said second plate engages said second lever, respectively.

18. A control system as in claim 17 wherein said at least one motor is a bi-directional motor.

19. A control system for at least one door mechanism having a bolt coupled to a shaft, said bolt being movable between a protruding position and a withdrawn position as controlled by the rotation of said shaft, said control system comprising:

a motorized drive;

a user-activated controller for activating said motorized drive, said user-activated controller including a remote-signal sensing device coupled to said motorized drive for sensing a remotely sent activation signal used to activate said motorized drive;

a first device coupled to said motorized drive and said shaft for rotating said shaft in a direction of rotation as driven by said motorized drive; and a second device for detecting a position of said bolt just prior to said withdrawn position, for inhibiting rotation of said shaft for a period of time upon detection of said position of said bolt, and for permitting rotation of said shaft at the expiration of said period of time.

* * * * *